US007269498B2

(12) United States Patent
Damitz et al.

(10) Patent No.: US 7,269,498 B2
(45) Date of Patent: Sep. 11, 2007

(54) METHOD AND DEVICE FOR CONTROLLING AN INTERNAL COMBUSTION ENGINE

(75) Inventors: Jens Damitz, Illingen (DE); Ruediger Fehrmann, Leonberg (DE); Matthias Schueler, Steinheim (DE); Michael Kessler, Leonberg-Warmbronn (DE); Mohamed Youssef, Nuefringen (DE); Vincent Dautel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 249 days.

(21) Appl. No.: 10/520,103

(22) PCT Filed: Jun. 18, 2003

(86) PCT No.: PCT/DE03/02043

§ 371 (c)(1),
(2), (4) Date: Aug. 22, 2005

(87) PCT Pub. No.: WO2004/005686

PCT Pub. Date: Jan. 15, 2004

(65) Prior Publication Data

US 2006/0085119 A1 Apr. 20, 2006

(30) Foreign Application Priority Data

Jul. 2, 2002 (DE) ..... 102 29 719
Feb. 12, 2003 (DE) ..... 103 05 656

(51) Int. Cl.
*F02D 45/00* (2006.01)

(52) U.S. Cl. ..... 701/111

(58) Field of Classification Search ..... 701/111, 701/102, 110, 115; 73/118.1
See application file for complete search history.

(56) References Cited

U.S. PATENT DOCUMENTS 4,850,218 A * 7/1989 Tutumi ..... 73/118.2
5,363,303 A 11/1994 Kaneko et al.
6,196,184 B1 3/2001 Bohnig et al.
6,390,068 B1 5/2002 Hartke et al.

FOREIGN PATENT DOCUMENTS

| | | |
|---|---|---|
| DE | 195 36 110 | 4/1997 |
| DE | 196 121 79 | 8/1997 |
| DE | 100 28 995 | 12/2001 |
| DE | 100 32 931 | 2/2002 |
| DE | 10050956 | 5/2002 |
| EP | 518501 | 12/1992 |
| EP | 0 959 237 | 11/1999 |
| JP | 2002-180888 A * | 6/2002 |
| WO | WO 02/16170 | 2/2002 |

OTHER PUBLICATIONS

Patent Abstracts of Japan, vol. 012, No. 057 (Feb. 20, 1988), & JP 62 203958 (Sep. 8, 1987).

* cited by examiner

*Primary Examiner*—Hieu T. Vo
(74) *Attorney, Agent, or Firm*—Kenyon & Kenyon LLP

(57) ABSTRACT

A device and a method for controlling an internal combustion engine, in particular a diesel engine, are described. Based on the signal from a structure-borne noise detector, parameters are determined which are used to regulate the internal combustion engine. At least one parameter is determined through an analysis that includes a filtering which selects at least two angular ranges.

9 Claims, 3 Drawing Sheets

METHOD AND DEVICE FOR CONTROLLING AN INTERNAL COMBUSTION ENGINE

FIELD OF THE INVENTION

The present invention relates to a method and a device for controlling an internal combustion engine.

BACKGROUND INFORMATION

A method and a device for controlling an internal combustion engine, in particular a diesel engine, are discussed in German Published Application No. 195 36 110. Based on the signal from a structure-borne noise detector, variables are determined there which are used to regulate the engine.

SUMMARY OF THE INVENTION

According to the present invention, parameters are determined on the basis of the signal from a structure-borne noise detector. These are used to regulate the engine. The analysis of the structure-borne noise signal includes at least one filtering, which selects at least two angular ranges. The parameters are derived on the basis of the appropriately processed signal. Because a plurality of angular ranges are analyzed, reliable determination of the events to be analyzed is possible.

It is advantageous that at least two parameters are determined. One parameter may be determined for each angular range in which an analysis takes place.

In a particular embodiment, new parameters are determined through division of the parameters among each other. As an example, two parameters K1 and K2 are determined through filtering in at least one angular range each, and a quotient is found. Through division of the two parameters, which characterize the intensity of noise emission in the two sub-ranges, the actual parameter is then determined through establishment of a ratio, which is independent of absolute signal values and hence of sensor tolerances and sensor drifts.

In an advantageous design, the parameters are compared to setpoint values. Depending on this comparison, manipulated variables are specifiable which influence the injection and/or the position of the intake valves and/or of the exhaust valves. The determined parameters characterize certain events and/or points in time. For example, the parameter may characterize the noises detected in the corresponding measuring window. In the case of a pilot injection there is a simple correlation between the noise emission and the quantity of fuel injected.

It is advantageous if, using a cross correlation, a correlation coefficient which characterizes the deviation of the measured signal from a reference signal is determined as a parameter.

The reference signal may correspond to the structure-borne noise signal in certain states. For example, the reference signal corresponds to the structure-borne noise signal associated with a desired pilot injection.

DETAILED DESCRIPTION

Figure 1:
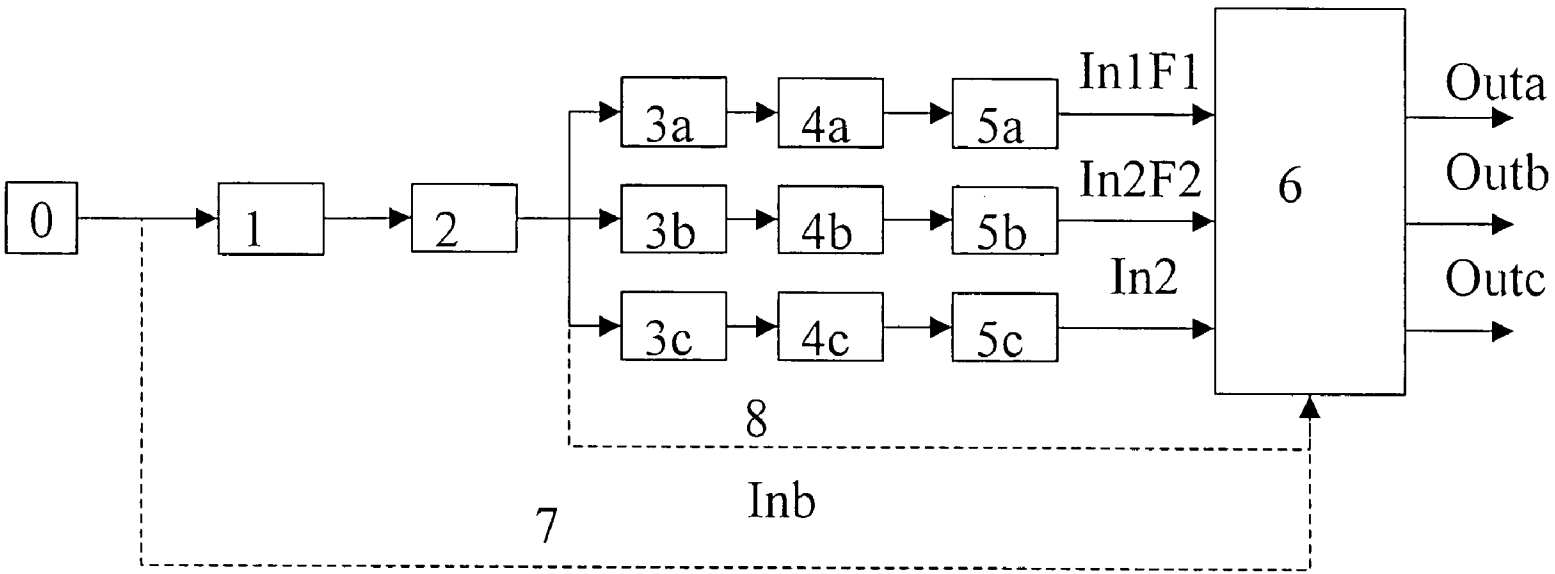
FIG. 1 shows a block diagram of the method according to the present invention.

FIG. 1 illustrates an embodiment of the method according to the present invention for measuring and analyzing the structure-borne noise signal as a block diagram. Reference index 0 indicates a structure-borne noise detector, 1 indicates an anti-aliasing filter, 2 indicates a windowing unit; 3*a*, 3*b*, 3*c* indicate three parallel FIR filters, 4*a*, 4*b* and 4*c* indicate three parallel absolute-value generators, and 5*a*, 5*b* and 5*c* indicate three integrators. A plurality of branches are shown for the FIR filters, the absolute-value generators and the integrators. In the exemplary embodiment, three parallel branches are shown. For other embodiments, different numbers of parallel branches may also be provided.

The parallel FIR filters are freely parameterizable in that different frequency ranges may be considered simultaneously. This is advantageous, since due to extraneous noises in the vehicle, caused for example by a pump switching on or by valve noises from a different cylinder, interference signals superimpose the actual useful signal in certain frequency ranges. Through the filtering, one and/or more frequency ranges are selected in which the useful signal may be measured without any interference, if possible. The combination of a plurality of selected frequency ranges makes more reliable recognition of the useful signal possible.

The output signals of the individual branches are supplied to a controller 6. An output signal is forwarded for each angular range considered and each frequency range considered. In the illustrated embodiment, a signal of a first partial injection which is filtered using a first filtering procedure is designated with In1F1. A signal of a first partial injection which is filtered with a second filtering procedure is designated with In1F2, and a signal of a second partial injection which is filtered with the first filtering procedure is designated with In2. Signals which are assigned to at least one angular range are filtered using at least one filtering procedure. Signals of a plurality of angular ranges may be filtered using a plurality of filtering procedures. An angular range is assigned in particular to a partial injection of a combustion process.

Three filters may be used, which are calculated across the entire range of analysis, i.e., for all injections. Due to the windowing, angular ranges which contain no signal portion and/or in which interference occurs are excluded.

In one embodiment, controller 6 may be connected through a first connection 7 directly to structure-borne noise detector 0 and/or through connection 8 directly to windowing unit 2. Outa designates a manipulated variable for valve control, Outb designates a manipulated variable for controlling the beginnings of triggering of pilot, main, and post-injections, and Outc designates a manipulated variable for controlling the duration of actuation of pilot, main, and post-injections. These variables are chosen merely as examples; only individual ones of these variables, or all of them, may be issued.

As shown in FIG. 1, the structure-borne noise signal is measured in one or more measuring windows. Two to three measuring windows per injection may be provided. A measuring window is defined by the position and length of the window.

The window location corresponds to the angular position of the camshaft and/or of the crankshaft at which the detected variable is expected to occur. The window length corresponds to the angular range by which the detected variable may change. The angular position and length are variably adjustable to permit detection of different variables. The windowing unit selects the angular range to be analyzed, within which the structure-borne noise signal will be analyzed. Different measuring windows are specified, depending on what variable is to be obtained as the output variable. A partial injection may be assigned to each window. At least one measuring window is assigned to the individual partial injections.

Three parallel paths may follow, each having what is known as a FIR filter 3*a*, 3*b* and 3*c*, an absolute value generator 4*a*, 4*b* and 4*c*, and an integrator 5*a*, 5*b* and 5*c*. The structure-borne noise signals thus analyzed go to controller 6. In addition, unprocessed structure-borne noise signal Inb is forwarded through connection 7 to controller 6, and/or output signal Inb from windowing unit 2 is forwarded through connection 8. The abbreviation FIR stands for Finite Impulse Response. The time signal is transformed into the frequency range, and defined frequency components are selected. Advantages compared to conventional filters are that a linear phase pattern is implementable, and that greater degrees of freedom are possible in the filter design. In improved embodiments, more paths may also be provided.

As alternatives to the FIR filter, other filters with different transmission characteristics may also be provided. Bandpass filters, lowpass filters, highpass filters, band-stop filters, and/or non-linear filters are among the filters that may be used. In particular, filters that select certain frequency ranges may be used.

As alternatives to the absolute value generation, squaring or similar functions may also be used. It is useful for at least one variable to be formed that characterizes the signal power, which is a function of the square of the signal amplitude.

Alternatively, for integration over certain angular ranges, averaging is also possible in these angular ranges, if division or a similar mathematical operation is used to examine the different parameters relative to each other.

Controller 6 applies a first manipulated variable signal Outa to a valve control unit, which is not shown. This signal may influence the opening and/or closing times of the intake valves and/or exhaust valves. Controller 6 also applies a second signal Outb, which influences the beginning of actuation of one or more pilot, main, and post-injections, to final controlling elements, not shown, which influence the metering of fuel. Controller 6 also applies a third signal Outc, which determines the duration of actuation and hence the quantity of one or more pilot, main, and post-injections, to illustrated final controlling elements which influence the metering of fuel.

Figure 2:
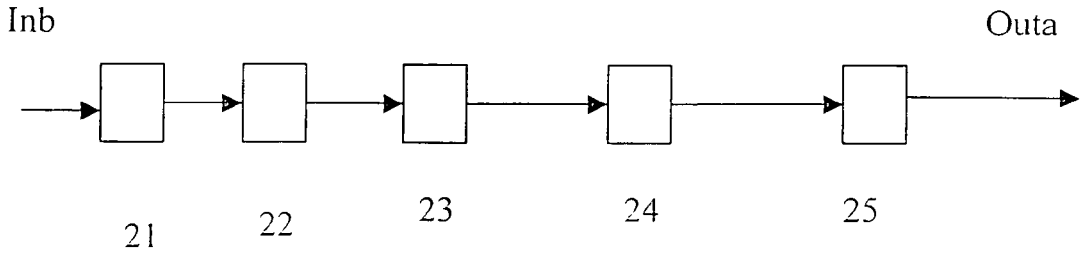
FIG. 2 shows a first version of the analysis of the structure-borne noise signal according to the present invention.

FIG. 2 shows the signal processing in controller 6 in greater detail, using input variable Inb as an example. Reference index 21 designates a runtime correction, 22 designates an interference compensation, 23 designates an averaging, 24 designates a computation of statistical variables, and 25 designates a switching between control and regulation that depends on the level of interference.

A structure-borne noise detector may be used for a plurality of cylinders of the internal combustion engine. The noise wave produced in the combustion chamber requires a propagation time to reach the sensor. For that reason, the signals from cylinders at a greater distance from the sensor reach the sensor later than those from the more proximate cylinders.

This propagation time, or the necessary correction, is a defined variable which is a function of the location where the sensor is installed. This variable is applied beforehand on the test bench or vehicle, in order to be taken into account during signal processing. For block 21 this means that the signals containing the previously applied variables are time-shifted here.

The useful signals are superimposed by interference signals caused by extraneous noises. For example, the valve stroke of another cylinder causes a parameter oscillation in the signal pattern. These interferences are determined beforehand on the test engine. These interference signals are compensated for in interference compensation 22.

To this end, certain characteristic oscillations in certain time ranges are subtracted from the measured signal. In the case of interference signals with characteristic frequency components, these are subtracted from the frequency spectrum.

In block 22, the interference signals which occur and are determined earlier on the test engine are therefore subtracted from the input signal in the time and/or frequency range.

Averaging 23 determines an average of a plurality of variables. Computation 24 determines various statistical variables, such as the variance. Evaluation 25 causes switching between characteristic-map-controlled operation and regulated operation based on the interference level of the signal. If the interference level does not exceed a threshold value, regulation of the corresponding output variable occurs. The output variable is determined depending on the comparison of a measured value, or of a variable calculated from a plurality of measured values, with a reference variable.

Figure 3:
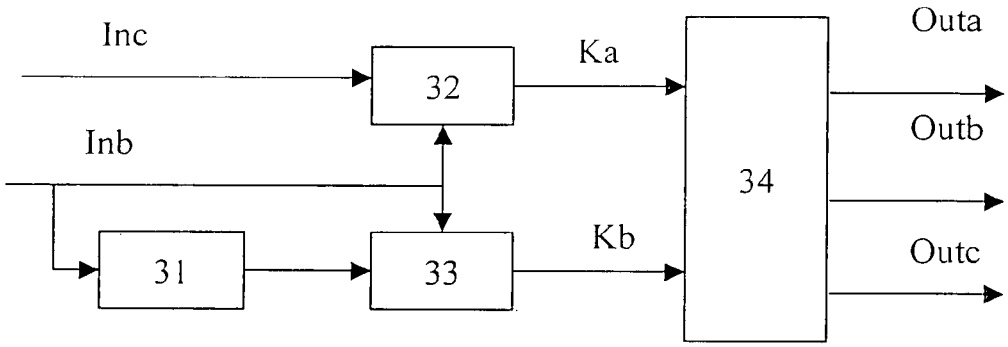
FIG. 3 shows a second version of the analysis of the structure-borne noise signal according to the present invention.

FIG. 3 shows the analysis of the structure-borne noise signals conveyed via connection 7 and/or 8 in controller 6. Inc designates a reference signal, and Inb designates the structure-borne noise signal which is conveyed via connection 7 and/or connection 8. 31 designates an integrator and 32 designates an analysis procedure.

The structure-borne noise signal is supplied to integrator 31. The structure-borne noise signal and the reference signal are supplied to analysis procedure 32. In addition, a threshold value forming function is designated with 33, and a weighting and/or combination of features is designated with 34. The output signal from integrator 31 and the structure-based noise signal are supplied to threshold value forming 33. The output signals from threshold value forming 33 and from analysis procedure 32 are supplied to the weighting and/or combination of features 34. The weighting and/or combination of features may be designed as a Kalman filter.

The output signal from analysis procedure 32 is designated as parameter Ka. This may refer to the times at which certain signals occur and/or to information about the similarity of the input signals, which is also referred to as the correlation coefficient. The output signal from threshold value forming 33 is also designated as parameter Kb. These characterize the times at which certain signals occur. The output values of weighting function 34 correspond to the output values of controller 6.

The analysis of the processed structure-borne noise signals, which reach controller 6 through connection 7 or 8, takes place via block 32 and/or block 33. Both in block 32 and in threshold value forming 33, reference signals are used. Structure-borne noise signals which have been measured under defined operating conditions are used as reference signals. For example, structure-borne noise signals that occur in deceleration and/or structure-borne noise signals that occur together with only a pilot, main, or post-injection, may be used as the reference signal. The reference signals may be detected in the corresponding operating states and saved in suitable storage media.

A CCF and/or a wavelet analysis and/or a FIR filtering may be employed as analysis procedures.

One possibility for analyzing the signals is spectral analysis. The object here is to describe the signal power in the frequency range. The following tools are provided, individually or in combination.

In the CCF, also referred to as the cross-correlation function, convolution of the signals occurs in the time range. These methods are used to evaluate a measured signal. The CCF is used to analyze the similarity of the signal to reference signals. The correlation coefficient describes the agreement. Variable 1 designates identical signal and reference signal curves. As an additional outcome of the CCF, the moment when a particular event occurs in the signal is recognizable.

Through the calculation of the cross correlation function between the reference signals and the measured signals, the absolute times and/or the angle positions of the signal oscillations are determined.

The FIR is used to reduce noise and to select relevant frequency ranges. It enables calculation of the power of certain frequency components. Windowing of the signals also makes it possible to determine in which measuring window and hence, when an event occurs in the measuring signal.

Wavelet analysis, in which the signal is convoluted with a reference signal, corresponds to simple FIR filtering. Its simple implementation in software and hardware is advantageous.

The analysis in block 32 includes at least two possibilities with which the parameters may be calculated and the regulation implemented. To increase precision and reliability, in advantageous embodiments the calculated features are combined using mathematical operations and weighted, in particular by using what is known as a Kalman filter.

This analysis of the signal oscillations and the parameters calculated from them make the following procedure possible. Various events trigger characteristic noise waves, which cause oscillations in the structure-borne noise signal. The described procedures are used to recognize when this oscillation occurs, and/or with which of the reference signals there is great similarity. The time position and/or the angular position is determined in the first procedure; a correlation coefficient is determined in the second procedure.

Block 33 contains the analysis of the measured structure-borne noise signals and/or of the integral values. A starting time in the signal is recognized when a defined, operating-point-dependent threshold value is exceeded. Starting with the parameters calculated using this method, the times at which an intake valve and/or an exhaust valve closes and/or opens, top dead center occurs, the individual partial injections begin or end, and/or combustion begins or ends are recognized. A corresponding time may be recognized when the correspondingly filtered signal exceeds certain threshold values. Different filtering methods are chosen for the structure-borne noise signal and the setpoint values for the different variables.

In addition to pressure changes due to the combustion, noise waves due to engine add-ons and/or ancillary units influence the structure-borne noise signal. Operating the intake valves and/or the exhaust valves causes mechanical vibrations, which are recognized by the structure-borne noise detector as characteristic oscillations in the signal pattern. According to the present invention, the angular ranges of the structure-borne noise signals in which these vibrations preferably occur are filtered out by windowing unit 2 and/or the FIR filtering. Through the analysis of the appropriately filtered signal, the angular positions at which the intake and/or exhaust valves open and/or close are determined. According to the present invention, the variables thus determined are supplied as an actual value to a regulator, which, based on a comparison of this actual value with a setpoint value, determines a corresponding manipulated variable to be applied to a final controlling element which operates the intake valve and/or exhaust valves. This enables the time position and/or the angular position to be determined directly. In addition, through the assignment of the measured signal to the reference signals, the oscillation which occurs is assigned to a particular event or a certain operating state. Thus it is recognized that a measured oscillation correlates with the closing or opening of the valve.

In the vicinity of the top dead center, a characteristic oscillation occurs in the signal pattern at fixed angular positions. It is recognized by analyzer 32, and is used for example for TDC recognition and calibration.

The onset of combustion causes an oscillation in the structure-borne noise signal. Recognition of the beginning of combustion, and thus of the ignition delay, makes it possible to regulate the moment when injection begins.

Furthermore, by detecting the beginning of combustion of the main injection it is possible to draw conclusions about the pilot injection quantity, since the pilot injection quantity decisively influences the ignition delay of the main combustion. According to the present invention, the variables thus determined are supplied as an actual value to a regulator, which, based on a comparison of these actual values with a setpoint value, determines a corresponding manipulated variable to be applied to a final controlling element that controls the start and/or duration of actuation of pilot, main, and post-injections.

The analysis of the structure-borne noise signals using blocks 1, 2, 3, 4 and 5 yields a number of parameters which are determined by the number of measuring windows times the number of injections per injection cycle. The processing of these parameters is shown in FIG. 4.

Figure 4:
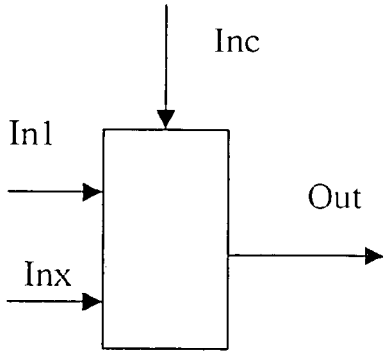
FIG. 4 shows a third version of the analysis of the structure-borne noise signal according to the present invention.

The structure-borne noise signals shown in FIG. 4 are analyzed in controller 6. Variables In1 through Inx correspond to the output signals of blocks 5*a*, 5*b* and 5*c*. Inc designates the reference signal or signals. Number x of input variables In1 through Inx may correspond to the number of partial injections times the number of measuring windows per partial injection.

A plurality of parameters in the same injection, injection into a plurality of cylinders, and/or a plurality of partial injections are thus averaged. In addition to averaging, additional statistical variables such as the variance may be determined.

Furthermore, the parameters of different windows within a cycle may be compared and/or analyzed with each other.

A comparison and/or an analysis of the parameters of the different windows from cycle to cycle is also advantageous.

It is particularly advantageous if there is a comparison and/or an analysis of the parameters of the different windows with reference signals Inc which were measured under defined conditions.

The pilot injection drastically influences the noise and exhaust emissions through strong influences on the combustion process. This has an effect on the ignition delay and on the gradient of the cylinder pressure curve. The structure-borne noise signal is a direct measure of the changes occurring in the cylinder pressure. The parameters for the pilot and/or main combustion calculated from the structure-borne noise signal exhibit a significant dependence on the pilot injection quantity. The effects of the pilot injection on the structure-based noise signal are used to optimize the pilot injection. Here optimization means reducing or increasing the pilot injection quantity while maintaining defined ignition delays and cylinder pressure gradients.

The comparison and the analysis make use of the fact that the reaction rate and the quantity of fuel injected influence the parameters. Greater quantities of fuel and faster reaction rates affect the signal intensity in various frequency ranges. These influences are recognized through the filtering, absolute value generation and integration. Comparison of the signals with each other and with parameters that were determined under reference conditions provides the desired relationship with the quantity of fuel injected and the times of the individual injections, thereby making it possible to regulate them.

The analysis according to path 1-2-3-4-5 in FIG. 1 divides both the main injection and the pilot injection into various measuring windows, in each of which the analysis occurs. The result, in particular the signal value integrated over the measuring window, corresponds to a combination of integrator values that is characteristic of this operating point. Increasing this pilot injection quantity results in greater pilot combustion, and earlier and hence longer main combustion. That has the effect on the integrator values of the pilot injection, that generally higher values occur. In the main combustion, the integrator values of the earlier measuring windows increase, since the main combustion takes place earlier. The values of the mean measured variables decrease, since the rate of combustion is lower. According to the present invention, the times and quantities of injection are determined by comparing the measured pattern with the patterns determined under reference conditions.

The present invention provides for at least one of the parameters In to be determined. This parameter is supplied to a regulator as an actual value. The corresponding parameter Inc, which occurs when a pilot injection takes place with an optimal pilot injection amount, is used as the setpoint value. If the parameters measured in ongoing operation deviate from the parameter with optimal pilot injection, the regulator influences the pilot injection quantity through manipulated variable Out in such a way that the difference between the setpoint value and the actual value is reduced.

Figure 5:
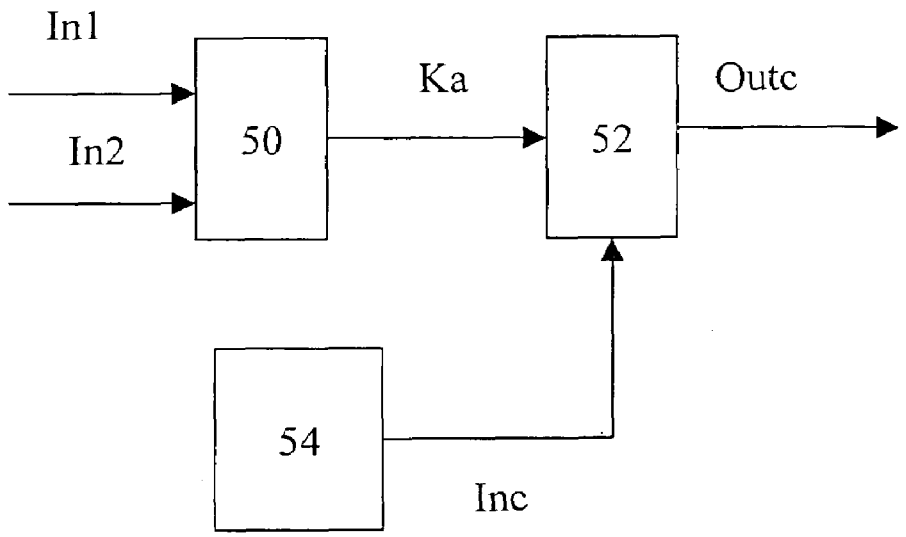
FIG. 5 shows another version of the analysis of the structure-borne noise signal according to the present invention.

A particularly advantageous embodiment is shown in FIG. 5. At least two filtered signals In1 and In2, which are determined through appropriate filtering and signal processing by means of blocks 1 through 5, are sent to a divider 50. Output signal Ka, which represents a parameter, is sent to a regulator 52, to whose second input reference signal Inc is applied. This reference signal Inc is provided by a setpoint value generator 54.

The procedure of the embodiment in FIG. 5 will now be described on the basis of the example of a pilot injection and a main injection. The procedure is not limited to this combination. It may be utilized with any combination of partial injections, i.e., at least one first partial injection and at least one second partial injection (see above). Instead of the output signal from blocks 1 through 5, it is also possible to use a parameter Ka determined from it, i.e., a variable calculated from a plurality of variables In may also be used.

Filtering is used to determine a first value In1 that characterizes the noise emission of the pilot injection, and a second value In2 that characterizes the noise emission of the main injection. Through division this produces parameter Ka. This corresponds to the ratio of the parameter for the pilot injection and the parameter for the main injection. Based on this ratio, which corresponds to the ratio between pilot injection and main injection, manipulated variable Outc is then specified. This means that the duration of the pilot injection is adjusted based on the ratio of the noise emission from the pilot injection and the noise emission from the main injection. This means that a third parameter is determined through division of two parameters.

In this particular embodiment, new parameters are determined through division of the parameters by each other. In particular, two parameters K1 and K2 are determined through filtering in at least one angular range each, and the quotient K3=g,K1/K2 is formed, where g represents an additional weighting factor. By dividing the two parameters, which characterize the intensity of noise emission in the two sub-ranges, the actual parameter is then determined through establishment of a ratio, which is independent of absolute signal values and hence of sensor tolerances and sensor drifts.

These angular ranges are in particular ranges a, which are characteristic of certain partial injections such as the pilot injection and the main injection; ranges b, which are characteristic of certain partial injections under certain process conditions; ranges c, in which no combustion takes place; and/or ranges d, in which characteristic interferences such as valve clattering occur.

The quotients of the parameters between the ranges that are characteristic of the pilot injection and the ranges that are characteristic of the main injection may be considered. Alternatively or in addition, the quotients of the parameters between ranges having injection and ranges having no injection are formed. Furthermore, it is possible to consider the parameters of ranges between which the weight of the partial combustions shifts depending on process conditions.

It is particularly advantageous if the manipulated variable is determined using a regulator. To this end, parameter Ka is compared to a setpoint value Inc. The manipulated variable or a setpoint value that depends on the operating state is then specified based on the comparison. A constant setpoint value or a setpoint value that depends on the operating state may be specified.

As an alternative to regulation, adaptive control may also be provided. In certain operating states, parameter Ka is compared to setpoint value Inc. Based on the comparison, a correction value is determined and stored. In the other operating states, the manipulated variable is corrected using the stored correction value.

What is claimed is:

1. A device for controlling an internal combustion engine, comprising:

a structure-borne noise detector for generating a signal;

at least one filter, the at least one filter receiving the signal from the noise detector and generating filtered signals by selecting at least two angular frequency ranges; and a processor for determining at least one regulatory parameter for regulating the internal combustion engine, the at least one regulatory parameter being determined based on the filtered signals.

2. A method for controlling an internal combustion engine, comprising:

detecting a signal of a structure-borne noise detector; and determining at least one regulatory parameter for controlling the internal combustion engine based on the signal of the structure-borne noise detector, wherein the determining of the at least one regulatory parameter includes an analysis featuring a filtering of the signal of the structure-borne noise detector that selects at least two angular frequency ranges.

3. The method of claim 2, wherein at least two regulatory parameters are determined.

4. The method of claim 3, further comprising:

determining a third regulatory parameter based on a division of the at least two regulatory parameters.

5. The method of claim 2, further comprising:

comparing the at least one regulatory parameter to a setpoint value; and specifying, depending on a result of the comparison, at least one manipulated variable that influences at least one of an injection, a position of an intake valve, and a position of an exhaust valve.

6. The method of claim 2, wherein a correlation coefficient that characterizes a deviation of a measured signal from a reference signal is determined as the at least one regulatory parameter, by a cross-correlation.

7. The method of claim 6, wherein the reference signal corresponds to the structure-borne noise signal in preferred states.

8. The method of claim 2, wherein the at least one parameter is one of an angular position of a crankshaft and of an angular position of a camshaft at which an event occurs.

9. The method of claim 2, wherein the at least one regulatory parameter characterizes an intensity of a measured signal in selected angular ranges.

* * * * *